US007086963B1

(12) United States Patent
Onuki et al.

(10) Patent No.: US 7,086,963 B1
(45) Date of Patent: Aug. 8, 2006

(54) GOLF CLUB HEAD

(75) Inventors: Masahide Onuki, Miki (JP); Makoto Yoshida, Akashi (JP); Tetsuo Yamaguchi, Nishinomiya (JP)

(73) Assignee: SRI Sports Limited, Kobe (JP)

( * ) Notice: Subject to any disclaimer, the term of this patent is extended or adjusted under 35 U.S.C. 154(b) by 936 days.

(21) Appl. No.: 09/194,112

(22) PCT Filed: Apr. 14, 1998

(86) PCT No.: PCT/JP98/01706

§ 371 (c)(1),
(2), (4) Date: Nov. 23, 1998

(87) PCT Pub. No.: WO98/46312

PCT Pub. Date: Oct. 22, 1998

(30) Foreign Application Priority Data

Apr. 16, 1997 (JP) ..... 9-115316
May 20, 1997 (JP) ..... 9-147219

(51) Int. Cl.
*A63B 53/04* (2006.01)

(52) U.S. Cl. ..... 473/342; 473/345

(58) Field of Classification Search ..... 473/342, 473/349, 345, 346, 350
See application file for complete search history.

(56) References Cited

U.S. PATENT DOCUMENTS 4,398,965 A * 8/1983 Campau ..... 148/522
4,742,030 A * 5/1988 Masaki ..... 423/608
4,792,140 A * 12/1988 Yamaguchi ..... 273/DIG. 1
5,261,663 A * 11/1993 Anderson ..... 473/342
5,346,217 A * 9/1994 Tsuchiya et al. ..... 473/345
5,378,295 A * 1/1995 Yamashita et al. ..... 148/654
5,458,334 A 10/1995 Sheldon et al.
5,465,968 A * 11/1995 Aizawa et al.
5,499,814 A * 3/1996 Lu ..... 473/329
5,569,337 A * 10/1996 Yoshida et al. ..... 148/325
5,601,501 A * 2/1997 Kobayashi ..... 473/350
5,611,742 A * 3/1997 Kobayashi
5,643,103 A * 7/1997 Aizawa ..... 473/290
5,792,005 A * 8/1998 Sieleman et al. ..... 473/349
5,896,642 A * 4/1999 Peker ..... 473/342

FOREIGN PATENT DOCUMENTS

EP 0 168 041 A2 1/1986
JP 49-40211 * 4/1974
JP 59-228874 * 12/1984
JP 60-7873 * 1/1985
JP 62-151551 A 7/1987
JP 1-254179 * 10/1989
JP 6-269518 A 9/1994
JP 06254182 9/1994
JP 7-163687 A 6/1995
JP 7-216490 A 8/1995

(Continued)

OTHER PUBLICATIONS

Abstract of Nippon Sports Kogyo Shinbun issued in Apr. 7, 1997.

(Continued)

*Primary Examiner*—Stephen Blau
(74) *Attorney, Agent, or Firm*—Birch, Stewart, Kolasch & Birch, LLP

(57) ABSTRACT

A golf club head is described which has a hitting face for golf balls, the hitting face being formed at least partially by a metallic material satisfying the following relationship:

$$y \leqq 0.006x + 60$$

wherein
x is Young's modulus(unit: kgf/mm$^2$), and
y is tensile strength(unit: kgf/mm$^2$). The metallic material is preferably an amorphous metal.

49 Claims, 7 Drawing Sheets

FOREIGN PATENT DOCUMENTS

| | | |
|---|---|---|
| JP | 9-59731 | 3/1997 |
| JP | 09059731 | 3/1997 |
| JP | 9-322953 | 12/1997 |
| WO | WO 97/20601 | 6/1997 |

OTHER PUBLICATIONS

Abstract of Manual of Mechanical Engineering issued in Jul. 15, 1977.

* cited by examiner (A)

(B)

GOLF CLUB HEAD

This application is the national phase under 35 U.S.C. §371 of prior PCT International Application No. PCT/JP98/01706 which has an International filing date of Apr. 14, 1998 which designated the United States of America.

TECHNICAL FILDS

The present invention relates to a golf club head for hitting golf balls.

BACKGROUND OF THE INVENTION

Wood type golf club heads, for which has been mainly used persimmon, have recently turned to be those mainly made of metallic materials such as carbon steel, stainless steel, duralumin, titanium or the like. Such golf club heads can be provided with a larger head volume and a wider hitting face area as well as a larger moment of inertia for stabilizing the direction of a golf ball. In addition, a larger sweet spot in the head is obtainable so as to reduce the lowering of the resiliency of the ball on a miss hit. Moreover, a larger sized head of a golf club brings about a better stability upon address and permits a longer shaft to be fitted thereon for obtaining an increased carry of the ball.

Japanese Patent No. 2130519 (No. 33071 of Japan Patent Official Gazette of 1993) discloses a golf club head permitting an increase in carry by means of increasing the resiliency performance between the head and golf ball to the fullest. In said patent, a theory is disclosed that by means of approaching a frequency indicating the primary minimum of the mechanical impedance of the head of the golf club (hereinafter may be referred to in short as "a primary frequency of the mechanical impedance of head",) to the frequency indicating the primary minimum of the mechanical impedance of the golf ball (hereinafter may be referred simply to as "the primary frequency of the impedance of ball" which proves to be about 600 Hz to about 1600 Hz.), the initial speed of an impacted ball is raised to the fullest (hereinafter may be referred to as "the impedance matching theory").

"Mechanical impedance" is defined as the ratio of the magnitude of a force acting on a point to the responding velocity of another point when said force is applied. Namely, when a force applied to an object from outside and the responding velocity is expressed by F and V respectively, the mechanical impedance (Z) is defined as Z=F/V.

In order to reduce the primary frequency of the impedance of head, it is effective to reduce the rigidity of the hitting face of the head. For example, a larger area of the hitting face, a thinner hitting face, an application of a low Young's modulus material to the hitting face or the like can be cited.

In particular, it is empirically known that, the application of a low Young's modulus metallic material to the hitting face of head renders the feeling (hitting feeling) soft on hitting a golf ball and, favorable to say, even on a missed shot hitting transmits only a small shock to hands.

With a metallic material with a small tensile strength, even with a low Young's modulus, however, it is hard to secure a strength sufficient to endure a shock on impact. Moreover, to enlarge the thickness of the hitting face for obtaining the strength of the latter resulted only in little effect in reducing the rigidity of said face, which confirmed an existence of a limit also in reducing the primary frequency of the impedance of head.

Also even with a low Young's modulus, a metallic material with a small surface hardness suffers from such problems as the tendency of early wear, low scratch resistance or the like of the surface of the hitting face due to the friction with the ball on impact and sand caught between hitting face and ball on impact.

DISCLOSURE OF THE INVENTION

The object of the present invention is to provide a golf club head capable of increasing the carry on the basis of the above mentioned "impedance matching theory" on the basis of the obtaining a reduction in the rigidity of the hitting face with a strength durable to the shock on impact.

With this object, a golf club head is described having a hitting face for golf balls, the hitting face being formed at least partially by a metallic material, the metallic material satisfying the following relation:

$$y \geqq 0.006x+60$$

wherein x is Young's modulus(unit: kgf/mm$^2$), and y is tensile strength (unit:kgf/mm$^2$), The metallic material is preferably an amorphous metal, for example. Above all is preferred an amorphous alloy of a zirconium base.

Moreover, another object of the present invention is to obtain reduction in rigidity of the hitting face with a hardness capable of preventing wear and scratches due to the friction with golf balls on impact and the intervention of sand etc., by providing a golf club head capable of presenting a soft hitting feeling as well as a longer carry on the basis of the impedance matching theory.

With this object, a golf club head is described having a hitting face for golf balls, the surface of the hitting face being formed at least partially by a metallic material satisfying the following relation:

$$z \geqq (x/60)+200$$

wherein, x is Young's modulus(unit; kgf/mm$^2$), and z is Vickers hardness(unit; HV). The metallic material is preferably an amorphous metal, for example. Above all, an amorphous alloy of zirconium, base is preferred.

THE BEST EMBODIMENT FOR REALIZING THE INVENTION

Figure 1:
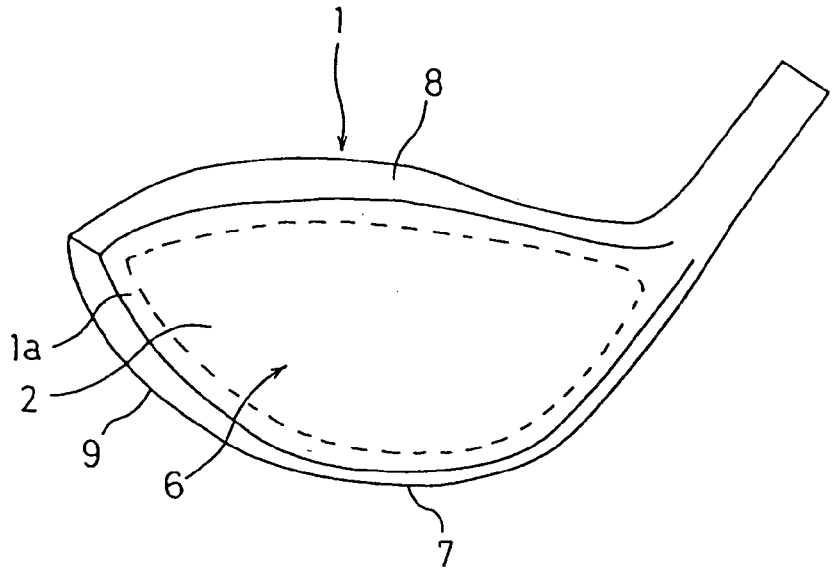
FIG. 1 is a front view of an embodiment of a wood type golf club head.
Figure 2:
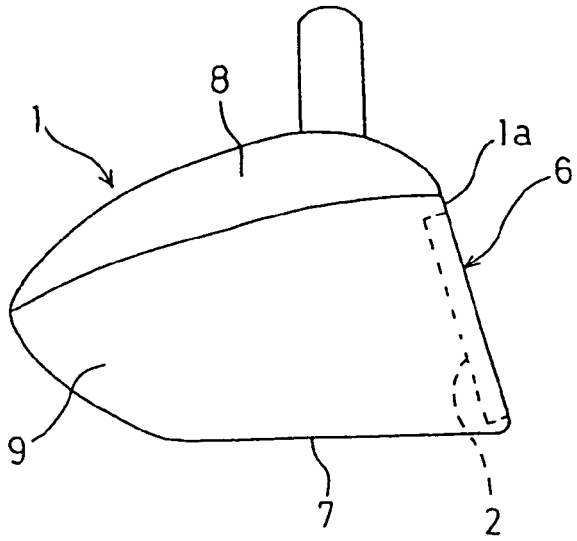
FIG. 2 is a lateral view thereof.
Figure 3:
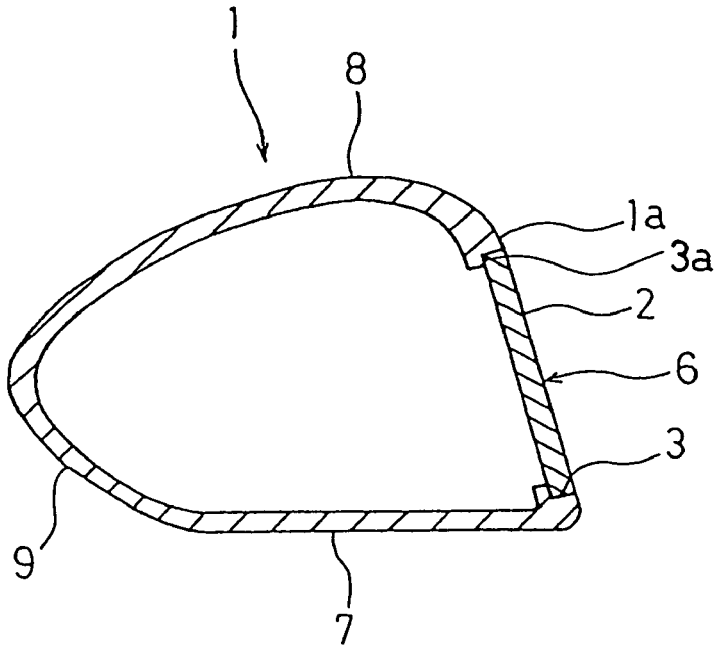
FIG. 3 is a cross sectional view of FIG. 2, (A) and (B) of FIG. 4 are cross sectional views of other embodiments of a golf club head.

An embodiment of the present invention will now be explained according to the drawings. FIG. 1, FIG. 2 and FIG. 3 illustrate a golf club head according to the present invention in the form of a hollow wood type golf club head formed by a metallic material. In this example, the head comprises a head body 1 and a face plate 2 arranged in front of the head body 1. And, it is preferable that the golf club head is provided with a head volume of, for example, about 80 $cm^3$ to about 360 $cm^3$, and more preferably of about 230 $cm^3$ to about 360 $cm^3$.

The head body 1 is provided with a face mounting part 1*a* constituting a periphery of a hitting face 6 for golf balls and permitting to fix thereon the face plate 2, a sole 7 adjoining the face mounting part 1*a*, a crown part 8 and a side part 9. The face mounting part 1*a* is represented, for example, in the form in which is formed an opening 3 for fitting bored through into the head which is provided with a stepped down zone 3*a* for attaching the face plate 2 as shown in FIG. 3.

Moreover, the face plate 2, which comprises the main part of the hitting face 6 in the present example, is disposed into said opening 3 for fitting by a joining means such as welding, caulking and adhesive so as to constitute the hitting face 6 in cooperation with the face mounting part 1*a*.

Figure 4:
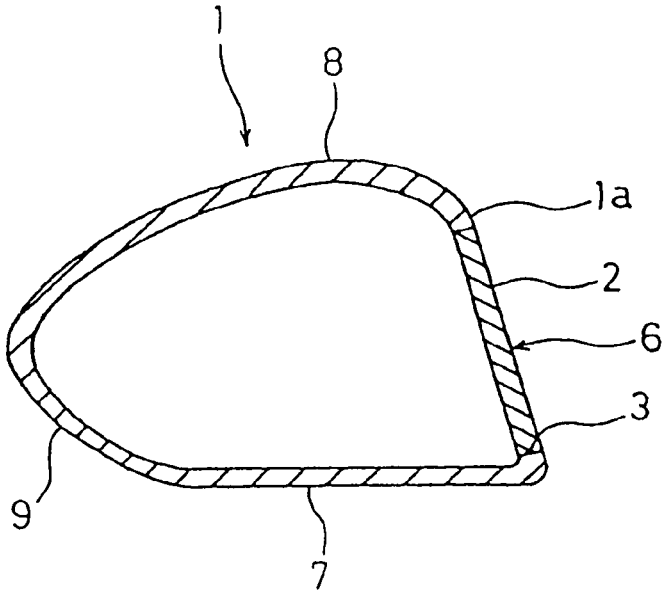
Figure 4:
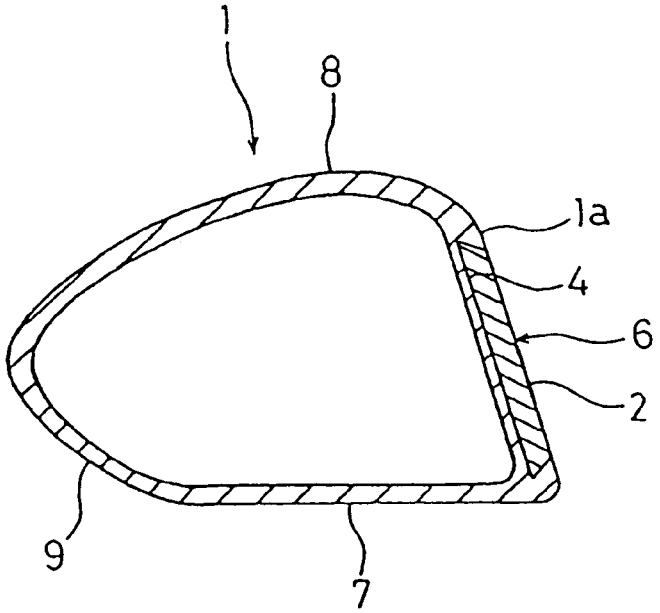

The face mounting part 1*a* may also be formed in the form of an opening 3 without the stepped down zone 3*a* as shown in FIG. 4(A) and also in the form of a tapered concave zone 4 for fitting which widens toward the inside of the head and permits support of the back of the face plate 2 as shown in FIG. 4 (B). In this case, it is preferable for the face plate 2 also to be made in the nearly same tapered form.

In addition, it was clear as a result of various experiments made by inventors that it is preferable that part of the hitting face 6 is formed by a metallic material satisfying the following relation:

$$y \geqq 0.006x+60$$

wherein x is Young's modulus(unit: $kgf/mm^2$), and y is tensile strength(unit: $kgf/mm^2$)

The present embodiment illustrates the face plate 2 which is formed by such metallic material as part of the hitting face 6. Consequently, part of the hitting face 6 (in the present example, the face plate 2 comprising the main portion of the hitting face 6) is capable of keeping its Young's modulus low with a tensile strength durable to the shock on impact being secured. Accordingly, the golf club head permits reduction in the primary frequency of the impedance of head and increases the carry of the golf ball according to said impedance matching theory or provides with a soft feeling of hitting by reducing the shock on impact.

In addition, the golf club head maintains its tensile strength high with its Young's modulus being maintained low, which allows for production of a lighter head by means of applying a smaller thickness for the hitting face 6 or the face plate 2. And also, for example, the smaller the thickness of the face plate 2 becomes, the more the spring constant of the head is reduced, resulting in obtaining a more reduced primary frequency of the impedance of head.

Moreover, in the present example, the face plate 2 is shown as having nearly uniform thickness. The thickness of the face plate 2 is preferably, for example, about 1 mm to about 4 mm, and more preferably to be about 1 mm to about 3 mm. The eventual thickness of the face plate 2 less than 1 mm tends to have a reduced strength and on the contrary, the eventual thickness more than 4 mm tends to have a less effect of the reduction of the primary frequency of said impedance of the head and the weight thereof.

By the way, the primary frequency of the impedance of golf ball ranges from about 600 Hz to about 1600 Hz, that of ordinary two-piece ball ranging from about 1000 Hz to about 1200 Hz. In contrast therewith, primary frequencies of the impedance of a wood type head formed of conventional stainless steel and of that made of titanium are about 1800 Hz to about 2500 Hz and about 1400 Hz to about 2000 Hz respectively.

A golf club head according to the present embodiment provides for a primary frequency of the impedance of head of less than that of conventional head and approximates or coincides with the primary frequency of the impedance of the golf ball.

For example, the present embodiment permitted the primary frequency of the impedance of head to be less than 1300 Hz. This is a value substantially coinciding with that of a two piece ball. Consequently, the golf club head of the present embodiment allows the initial velocity of hit ball to rise to its fullest on impact which results in increasing the carry.

Moreover, it is preferable that at least part of the hitting face 6 be formed by a metallic material satisfying the following relation:

$$y \geqq 0.006x+63$$

, and more preferably of a metallic material satisfying the following relation:

$$y \geqq 0.006x+100$$

wherein the definition of x and y is as shown above.

By the way, when the metallic material of the face plate 2, for example, is such that $y<0.006x+60$, the balance between tensile strength and young's modulus turns for the worse and it becomes difficult to reduce the rigidity of the hitting face with a strength durable to the shock on impact.

Moreover, in the present embodiment, the tensile strength of the metallic material of the face plate 2 is preferable to be maintained in such a degree as not increasing the thickness of the face plate 2 remarkably, namely it is preferable to be kept at not less than, for example, 80 $kgf/mm^2$, preferably not less than 105 $kgf/mm^2$ and more preferably not less than 130 $kgf/mm^2$. By the way, the upper limit of the tensile strength may be stipulated to be not more than 400 $kgf/mm^2$ in any combination with either of above lower limits in consideration of production problems.

Moreover, in the present embodiment the Young's modulus of the metallic material of the face plate 2 is preferable to be not less than, for example, 3000 $kgf/mm^2$ and preferably not less than 5000 $kgf/mm^2$. However, because a young's modulus that is too high is apt to raise the rigidity of the hitting face 6, its upper limit is preferable to be not more than 25000 $kgf/mm^2$ and preferably not more than 20000 $kgf/mm^2$ and more preferably not more than 16000 $kgf/mm^2$ and further preferably not more than 12000 $kgf/mm^2$ and more further preferably not more than 10000 $kgf/mm^2$ in any combination with either of the lower limits.

While these embodiments were based on lowering the rigidity of the hitting face with a strength durable to shock on impact, a description follows of such an embodiment which prevents the surface of the hitting face from wear or scratches caused by the friction with the ball on impact or by sand caught between the hitting face and ball.

As for the present embodiment also, it is applicable to the golf club head in a form as shown in FIGS. 1 to 3 or in FIGS. 4 (A), (B). The inventors have found that it is preferable to form the golf club head with a metallic material as at least part of the surface of the hitting face satisfying the following relation:

$$z \geqq (x/60)+200$$

wherein x is Young' modulus(unit: kgf/mm$^2$), and z is Vickers hardness (unit: kgf/mm$^2$).

For example, the face plate 2 is formed by metallic material which satisfied the above relation {z≧(x/60)+200}. By the way, the present example is so comprised that the surface of the face plate 2 is exposed without being provided with any surface layer of other metal, resin, wood or the like.

Moreover, the Vickers hardness of the metallic material is obtained from the relationship between the testing load when the testing surface was dented with an indenter of regular square pyramid of diamond with a facing angle of 136 degrees and the dent surface area, details of which are defined in Japanese-Industrial-Standard (JIS) or the like. The present invention stipulates the testing load as 30 kgf.

In the present embodiment, the face plate 2 can secure a high Vickers hardness so as to prevent the hitting face 6 from wear and scratch caused by the friction with the golf balls and sand caught within. Moreover, the metallic material of the face plate 2, which possesses the above stated relation of Young's modulus x with Vickers hardness z, allows for maintaining the Young's modulus low with a high Vickers hardness.

Accordingly, the golf club head of the present embodiment can reduce the primary frequency of the impedance of head, allowing for an increase in the carry of ball according to the impedance matching theory. In addition, part of the surface of the hitting face, which suffers from a reduced shock on impact because of a lower Young's modulus, provides a softer hitting feeling.

By the way, in the present embodiment, when the face plate 2 is a metallic material of z<(x/60)+200, the simultaneous satisfaction of such three performances as softer hitting feeling, increase in carry and durability of hitting face 6 prove to be unobtainable.

In addition, because the face plate 2 becomes capable of keeping the Vickers hardness high with the Young's modulus being kept low, a reduction in the thickness of the hitting face 6 (face plate 2) is also possible. Accordingly, a lighter head may be produced and the spring constant of head is increased corresponding to the reduction in the thickness of the face plate 2, a synergetic effect of which allows for a reduction in the primary frequency of the impedance of head.

Herein, the Vickers hardness of the face plate 2 is preferably selected to be not less than 250 HV, and preferably not less than 300 HV, more preferably not less than 370 HV, or further preferably not less than 400 HV, a very excellent injury resistance shall be ideally obtained. Moreover its upper limit may be stipulated as not more than 1000 HV from the view point of production problems or the like, also in a combination with either of said lower limits. The latter allows for obtaining a more suitable protection of the hitting face damage.

In addition, it is preferable that at least part of the surface of the hitting face 6 is formed by a metallic material satisfying the following relation:

$$z \geqq (x/60)+250$$

wherein the definition of x and z is as shown above.

In the present embodiment too, the Young's modulus of the face plate 2 is preferable to be, for example, not less than 3000 kgf/mm$^2$ and preferably not less than 5000 kgf/mm$^2$ for obtaining a required rigidity. However, because a Young's modulus that is too high is apt to render the rigidity of the hitting face 6 higher, its upper limit is desired to be not more than 25000 kgf/mm$^2$ and preferably not more than 20000 kgf/mm$^2$ and more preferably not more than 16000 kgf/mm$^2$ and further preferably not more than 12000 kgf/mm$^2$, more further preferably not more than 10000 kgf/mm$^2$ in combination with either of said lower limits.

Two embodiments have been described, for metallic material comprising such a face plate 2, it is preferable to use an amorphous metal, for example. The amorphous metal is defined as a metal whose atomic arrangement is not regular over a wide range. At present it is made mainly in such a manner that a fused alloy obtained by melting various alloy elements is rapidly cooled to solidify so as not produce a crystal nucleus. In the present embodiment, an amorphous metal whose amorphous ratio that is the degree of amorphousness, that is to say, the ratio of the volume v1 of the amorphous phase to the total volume v, (v1/v) is over 50% is preferably used.

The amorphous metal consists of a composition expressed by a general formula: $M_aX_b$ (wherein "a" and b are 65≦a≦100 and 0≦b≦35 at atomic %).

Herein, M consists of metallic elements of more than one kind selected from Zr, V, Cr, Mn, Fe, Co, Ni, Cu, Ti, Mo, W, Ca, Li, Mg, Si, Al, Pd, Be, and X consists of metallic elements of more than one kind selected from Y, La, Ce, Sm, Md, Hf, Nb, Ta. And preferably, above "a", b are preferable to be 99≦a≦100 and 0≦b≦1 at atomic % respectively.

Such amorphous metals, which may be provided simultaneously with a high tensile strength, a high Vickers hardness and a low Young's modulus, prove to be metallic materials particularly suitable to the golf club head of the present invention.

For the amorphous metal, amorphous alloys of zirconium base are more preferably applicable. The zirconium base amorphous metals are provided with a higher tensile strength as well as a lower Young's modulus. In addition, a relatively lower cooling velocity is applicable in production, and accordingly, they are practical and preferable also from the view point that by casting molten metal in a mold and cooling same to obtain bulk or plate form products with a relative ease.

The amorphous zirconium base alloys consist of a composition as shown by a general formula:

$$Zr_cM_dX_e$$

(wherein c, d and e are 20≦c≦80, 20≦d≦80 and 0≦e≦35 atomic % respectively).

Zr is zirconium, M is a metallic element of more than one kind selected from V, Cr, Mn, Fe, Co, Ni, Cu, Ti, Mo, W, Ca, Li, Mg, Si, Al, Pd, Be; and X consists of metallic elements more than one kind, selected from Y, La, Ce, Sm, Md, Hf, Nb, Ta.

In addition, said c, d and e are preferable to be 35≦c≦75, 25≦d≦65 and 0≦e≦30 respectively, more preferably to be 35≦c≦75, 25≦d≦65 and 0≦e≦1 at atomic %, and further preferably to be 50≦c≦75 25≦d≦50 0≦e≦1 at atomic % respectively. Moreover, said M is particularly preferable to be Al, Cu, Ni. Said X is preferable to be Hf. In particular, as such a zirconium base amorphous alloy, for example, $$Zr_cAl_{d1}CU_{d2}Ni_{d3}Hf_e$$

is preferable. (herein, shall be d1+d2+d3=d and c+d+e=100).

The amorphous metal is preferable to present an amorphous ratio mentioned above of not less than 75%, more preferably not less than 80% and further preferably not less than 90%. For example, such amorphous ratio can be identified by means of observing under an optical microscope to determine the area of amorphous portion after a mirror polishing followed by an etching treatment of a cut section of a sample of metallic material. And the amorphous ratio can be adjusted by modifying the alloy composition of amorphous metal, the cooling temperature of cooling fused alloy for producing an amorphous metal as well as the oxygen concentration of the ambient gases and so on. Above all, the more said cooling velocity is raised and the more the oxygen concentration of the ambient gases is reduced, the more the amorphous ratio can be raised.

By the way, as for the metallic material of the face plate 2, any kind of metallic material such as any alloy or elemental metal other than amorphous metals, so long as it satisfies the relation between said Young's modulus and tensile strength or that between Young's modulus and Vickers hardness, may be applied, without being limited to the illustrated amorphous alloys.

In connection with the present embodiment, various methods permit to change designs. For example, the face plate 2 may be constructed a thicker central part with a periphery part whose thickness reduces gradually to outwardly. In this case, it is possible to obtain the less primary frequency of the impedance of head without reducing the strength of face plate 2. On the contrary, the face plate 2 may be constructed a thinner central part with a periphery part whose thickness gradually increases to outwardly. In this case, it is preferable because the strength of the joint portion of the face plate 2 with the face mounting part 1*a* for receiving same is increased.

Moreover, the head body 1 may be formed by conventional metallic materials such as titanium, titanium alloys, stainless steels or the like for example.

Figure 5:
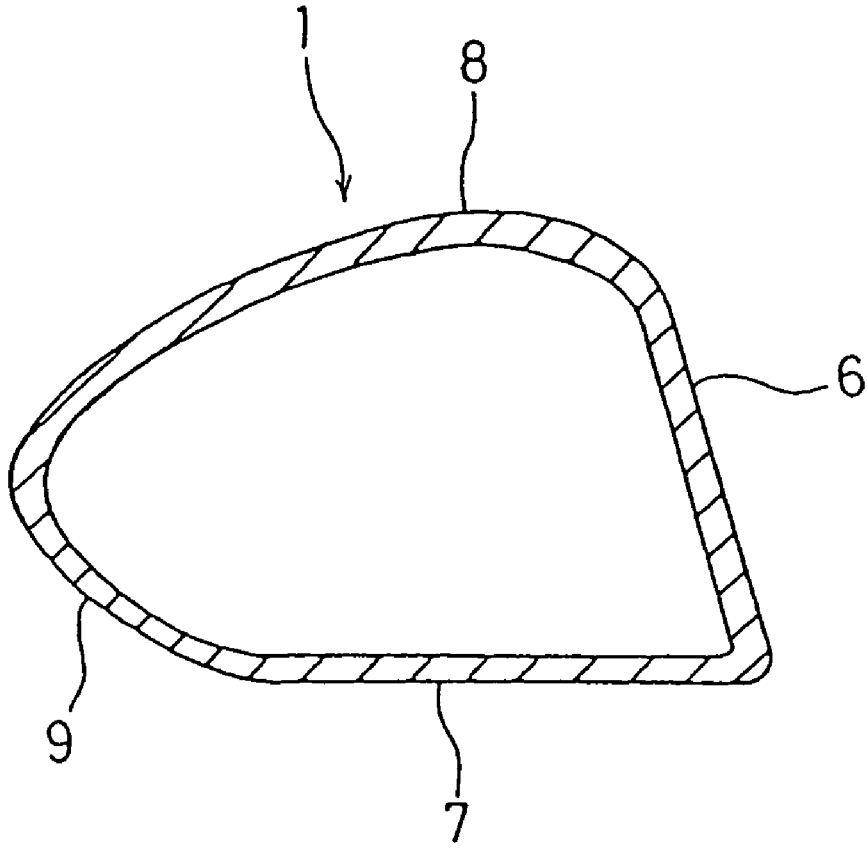
FIG. 5 is a cross sectional view of head showing another embodiment.

And also, as shown in FIG. 5, the hitting face 6, the sole 7, the crown part 8 and the side part 9 constituting a head as a whole may be formed by a metallic material satisfying the following relation:

$$y \geqq 0.006x+60$$

wherein the definition of x and y is as shown above, or may be formed by a metallic material satisfying the following relation:

$$z \geqq (x/60)+200$$

wherein the definition of x and z is as shown above. In these case, further improved shock endurance and hitting feeling are obtained, resulting in a further reduction in the primary frequency of the impedance of head.

Figure 6:
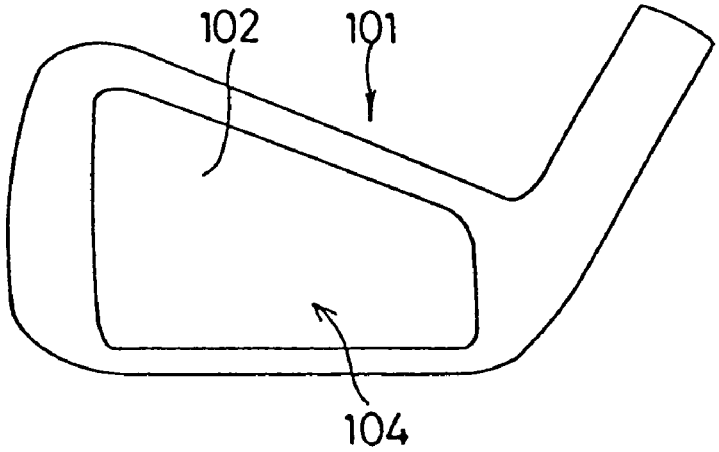
FIG. 6 is a front view showing an embodiment of an iron type golf club head.
Figure 7:
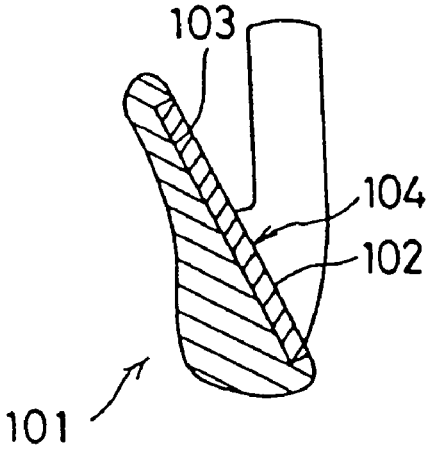
FIG. 7 is a cross sectional view thereof.

In FIGS. 6 and 7, as another embodiment of the present invention, a metallic iron type club head is shown. In this example, it is shown a golf club head which comprises a head body 101 and the insert plate 102 for the hitting face to be fitted on the side of the hitting face 104 of the head body 101. The insert plate 102 for the hitting face comprises the main part of the hitting face 104 to hit the golf ball chiefly on its surface. And the insert plate 102 for the hitting face of the present embodiment is shown formed in substantially uniform thickness as well as fitted in a fitting hollow formed on the side of the hitting face 104 of head body 101 and fixed by adhesion, welding, caulking, press in etc. Consequently, in this example, the back as a whole of the insert plate 102 for the hitting face comes into contact with or sticks to the head body 101, which results in an improvement of the durability of the hitting face 104.

Moreover, by means of applying for the insert plate 102 for the hitting face, for example, metallic material satisfying the following relation:

$$y \geqq 0.006x+60$$

wherein the definition of x and y is as shown above, or a metallic material satisfying the following relation:

$$z \geqq (x/60)+200$$

wherein the definition of x and z is as shown above, an effect similar to the above mentioned can be obtained.

While several embodiments were above described, although the present invention is preferable for wood type and iron type heads, it is also available for a putter type head.

In addition, in all embodiments above stated, the face plate 2 as well as the insert plate 102 for the hitting face may be formed by a metallic material simultaneously satisfying the following relations:

$$y \geqq 0.006x+60$$

$$z \geqq (x/60)+200$$

wherein the definition x, y and z is as shown above.

In this case, according to the impedance matching theory, such a further preferable golf club head is produced as possessing a strength durable to the shock on impact and a face with a very high durability hard to be injured, simultaneously with an improvement in carry of ball.

WORKING EXAMPLE

First Working Example

Wood type golf heads were produced (examples 1 to 6) with zirconium base amorphous alloys with variously varied alloy elements (Zr—Al—Cu—Ni—Hf, or Zr—Al—Cu—Ni) being applied to part of the hitting face. These golf club heads were used to investigate head speed, ball speed after hitting by the golf club head, resilience coefficient, carry (hitting distance from the hitting point to first dropping point of golf ball), total hitting distance, primary minimum frequency of the mechanical impedance of head and hitting feeling. The results were reported in Table 1. On the other hand, for comparison, references 1 and 2 were given wherein wood type hollow heads made of titanium and stainless steel were prepared for comparing several performances. The head speed, the ball speed, the resilience coefficient, the carry and the total hitting distance were determined by the hitting test by a golf swing robot. For measuring the primary minimum frequency of the mechanical impedance of the head was utilized an exciting measuring method wherein a vibration exciter, an acceleration pickup, a power unit, and a dynamic signal analyzer same as those utilized in said Japanese patent. Moreover, the hitting feeling was evaluated by 20 golfers who actually hitted and effected 5 steps of 1 to 5 points of sensuous evaluation on the basis of less shock, (whether or not being obtained a soft hitting feeling) for obtaining its mean value.

As clear from Table 1, while primary minimum frequencies of mechanical impedance of golf club heads in references 1 and 2 are 1450 Hz and 1980 Hz respectively, in examples, all frequencies are held below 1290 Hz. Accordingly, golf club heads in all examples obtained primary minimum frequencies of the mechanical impedance of heads less than those of conventional heads and it was confirmed that they approximated to the primary minimum frequency of the mechanical impedance of two piece ball (about 1000 Hz to about 1200 Hz). By the way, illustrated tensile strengths of metallic materials applied to the face plate were below 200 kgf/mm$^2$.

Moreover it is clear that resilience coefficient, carry, total hitting distance are all superior with examples to those with references 1 and 2. In addition as for hitting feeling also, that of examples 1 to 6 is superior to that of references 1 and 2.

In these examples, the thickness of the face plate (amorphous metal part) is set the smaller with increasing tensile strength. It is considered that this decrease in thickness further lowers the spring constant as regards the hitting face, which resulted in an increase in restitution coefficient, carry, and total hitting distance and an improvement in hitting feeling.

Figure 8:
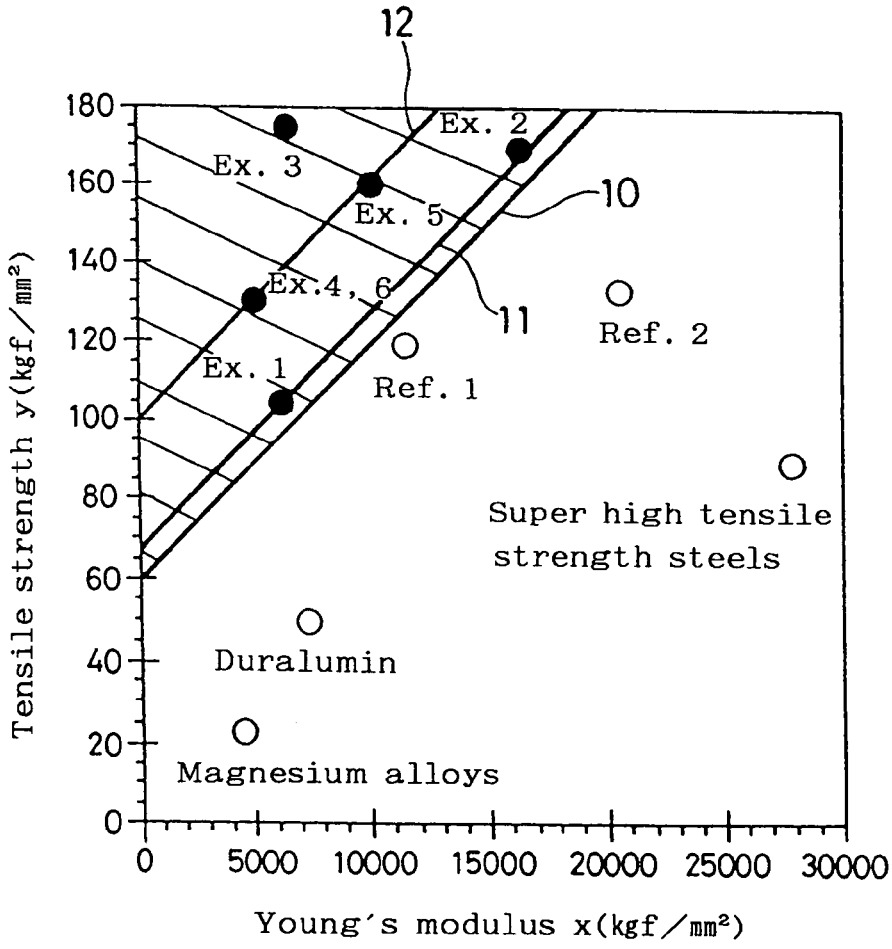
FIG. 8 is a graph showing the relation between Young's modulus and tensile strength.

Moreover, FIG. 8 shows the relation between Young's modulus x and tensile strength y. For metallic materials used for face plates of above mentioned examples 1 to 6 and references 1 and 2, were made plottings on FIG. 8. Equally for data of duralumin, magnesium alloys, and super high tensile strength steels were shown plottings likewise.

In FIG. 8, straight lines 10, 11 and 12 are graphs showing $y=0.006x+60$, $y=0.006x+63$, and $y=0.006x+100$ respectively. Herein, a range satisfying, $y \geqq 0.006x+60$ is indicated by oblique lines.

It is clear that while metallic materials used in examples satisfy $y \geqq 0.006x+60$, with materials used in references and with duralumin, magnesium alloy, super high tensile strength steels etc., $y<0.006x+60$ is satisfied.

Second Working Example

Next, as another working example of the present invention, a relation between Young's modulus and Vickers hardness was investigated. Heads of iron type similar to what was shown in FIGS. 6 and 7 (examples 7 to 9) and of wood type similar to what was shown in FIGS. 1 to 3 (examples 10 to 12) were produced. Moreover, iron type heads (references 4 to 6) and wood type ones (references 7 to 9) whose insert plates for hitting face and face plates were made of stainless steel, titanium, or duralumin were produced. And as for these heads, tests were made chiefly in connection with the injury resistance of the surface of the hitting face and the softness of hitting feeling.

The injury resistance of the surface of the hitting face was determined in such a manner that a golf ball placed on the ground was hit by a golf swing robot so as to let intervene a small amount of sands between the ball and the surface to examine the amount of injury on the surface of the hitting face. On the other hand, the softness of hitting feeling was evaluated by 20 golfers to adopt mean value of its results. And measuring load for Vickers hardness is of 30 kgf. Results of test are shown in Tables 2 and 3.

As clear from Tables 2 and 3, as for club heads of all examples, the surface of the hitting face is hard to be injured (little injured or very little injured) and presents a soft hitting feeling (good or very good). And, at least either of performances of the injury of the hitting face and the soft feeling resulted in very good.

Moreover, the example 7 gives a Vickers hardness similar to that of references 3, 4 (similar injury resistance) but its Young's modulus is very lowered. Accordingly it can be understood that the golf club head of this example permits to increase carry and provide with a soft hitting feeling on the one hand, it suffers little from injury from sands and pebbles on the other hand, presenting an excellent wear resistance.

Figure 9:
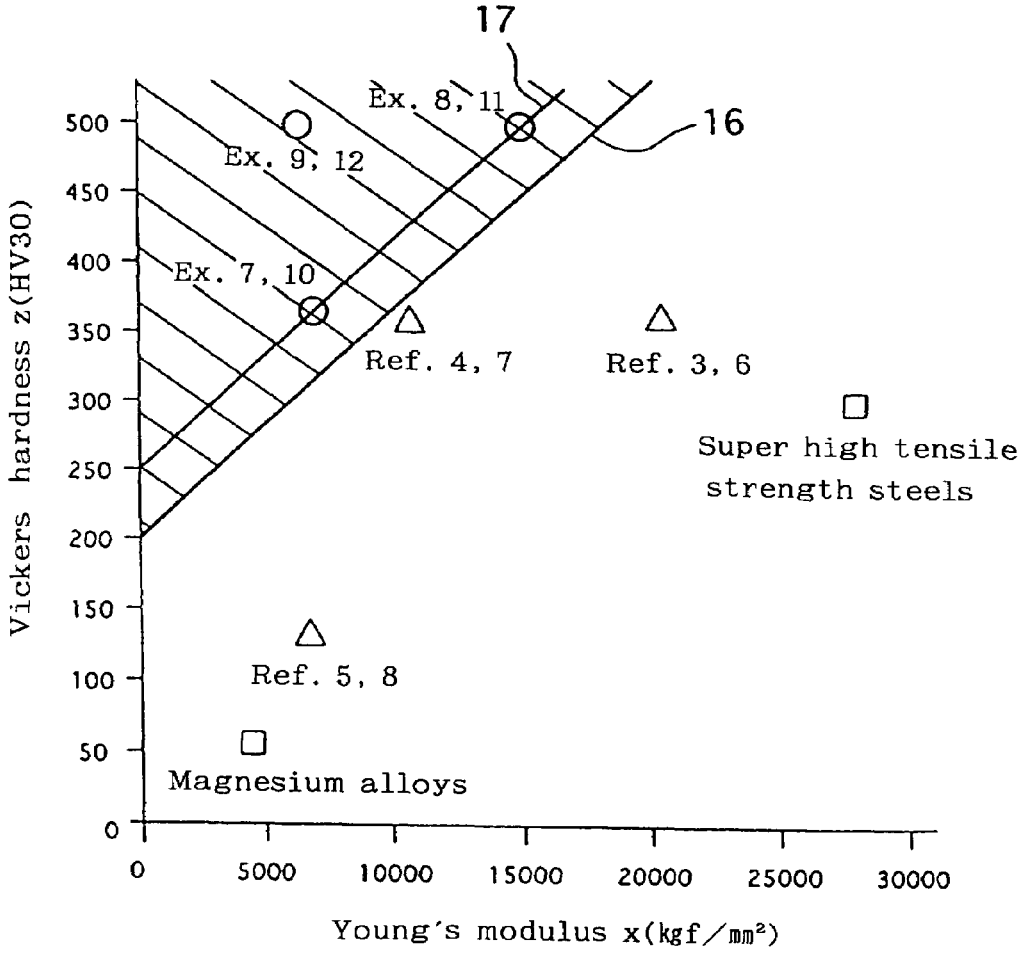
FIG. 9 is a graph showing the relation between Young's modulus and Vickers hardness.

And, FIG. 9 shows a relation between Young's modulus x and Vickers hardness z of metallic materials. The data of said metallic materials of face plates of examples 7 to 9 and references 3 to 8 and also of magnesium and super high tensile strength steels being plotted.

In said figure, straight lines 16 and 17 indicate $z=(x/60)+200$ and $z=(x/60)+250$ respectively. Moreover a range satisfying a relation $z \geqq (x/60)+200$ is shown by oblique lines. As clear from said figure, examples 7 to 12 satisfy the relation $z \geqq (x/60)+200$.

As described above, the golf club head according to the claim 1 permits part of the hitting face to be provided with a lower rigidity with a tensile strength durable to shock on impact being maintained. Accordingly, a golf club head with a less primary minimum frequency of the mechanical impedance of head than that of conventional golf club head is produced. For example, the value of the primary minimum frequency of the mechanical impedance of golf club head may be further approached that of golf ball. Consequently, a longer carry as well as softer hitting feeling may be obtained. Moreover, as for the golf club head, the thickness of its hitting face may be reduced and further reduction in weight may be attempted. And when the thickness of the hitting face was reduced, by an amount corresponding thereto the spring constant of the hitting face is reduced and moreover the primary minimum frequency of the mechanical impedance may be reduced.

And, with the golf club head according to the claim 2, for a metallic material suitable to said hitting face an amorphous metal is applied, which permits to obtain with ease a compromise between a high tensile strength and a low Young's modulus.

And with a golf club head according to the claim 3 or 4, an amorphous alloy of zirconium base is applied, which permits its simple production and in addition the compromise between a higher tensile strength and a lower Young's modulus.

And, with a golf club head according to the claim 5, at least part of the surface of the hitting face can be made so as to keep its low rigidity with its surface hardness durable to a friction and a sand intervention on impact being maintained. Accordingly, a primary minimum frequency of the mechanical impedance less than that of the conventional golf club is available with the durability and injury resistance of head being maintained. For example, the primary minimum frequency of the mechanical impedance of golf club head may be further approximated to that of golf ball. Accordingly, an increased carry as well as a softer hitting feeling at hitting is obtained. Moreover, a smaller thickness of the hitting face of the golf club head may be obtained, which means a further reduced weight being obtainable. In addition, a reduction in the thickness of the hitting face induces a reduction in the spring constant by its corresponding amount and in addition permits to further reduce the primary minimum frequency of the mechanical impedance.

With the golf club head according to the claim 6, an application of an amorphous metal as a metallic material suitable to said hitting face permits to achieve with ease a compromise of a high tensile strength with a low Young's modulus.

Moreover, the golf club head according to the claim 7 or 8, for which is applied an amorphous alloy of zirconium base, may be made in a simpler manner and in addition, a compatibility of a higher tensile strength with a lower Young's modulus may be attainable.

TABLE 1

| | Ex. 1 | Ex. 2 | Ex. 3 | Ex. 4 | Ex. 5 | Ex. 6 | Ref. 1 | Ref. 2 |
|---|---|---|---|---|---|---|---|---|
| Head speed Vh (m/s) | 41.02 | 41.27 | 41.21 | 41.13 | 41.09 | 41.24 | 41.38 | 41.30 |
| Ball speed Vb (m/s) | 58.66 | 58.85 | 59.59 | 59.27 | 59.13 | 59.51 | 58.84 | 58.48 |
| Resilience coefficient | 1.430 | 1.426 | 1.445 | 1.441 | 1.439 | 1.443 | 1.422 | 1.416 |
| Carry (m) | 210.8 | 210.1 | 216.2 | 213.2 | 212.9 | 214.9 | 207.6 | 206.5 |
| Total distance (m) | 232.4 | 229.5 | 238.2 | 235.0 | 234.7 | 237.1 | 228.4 | 223.7 |
| Face plate | | | | | | | | |
| Material | Amorphous alloy of zirconium base | Amorphous alloy of zirconium base | Amorphous alloy of zirconium base | Amorphous alloy of zirconium base | Amorphous alloy of zirconium base | Amorphous alloy of zirconium base | Titanium | Stainless steel |
| Composition (Atomic %) | | | | | | | | |
| Zr | 54 | 64 | 55 | 55 | 60 | 55 | | |
| Al | 10 | 10 | 10 | 10 | 10 | 10 | | |
| Cu | 30 | 15 | 30 | 30 | 20 | 30 | | |
| Ni | 5 | 10 | 5 | 5 | 10 | 5 | | |
| Hf | 1 | 1 | — | — | — | — | | |
| Amorphous ratio (%) | 57 | 82 | 96 | 77 | 82 | 80 | | |
| Young's modulus x ($kgf/mm^2$) | 7000 | 16000 | 6500 | 5000 | 10000 | 5000 | 11600 | 20800 |
| Tensile strength y ($kgf/mm^2$) | 105 | 160 | 175 | 130 | 160 | 130 | 120 | 134 |
| Thickness (mm) | 3.4 (Uniformly) | 2.5 (Uniformly) | 2.4 (Uniformly) | 3.0 (Uniformly) | 2.8 (Uniformly) | 3.0/2.5 in center/On periphery | 3.2 (Uniformly) | 3.2 (Uniformly) |
| Primary minimum frequency of the mechanical impedance of the hitting face (Hz) | 1260 | 1290 | 960 | 1130 | 1120 | 1080 | 1450 | 1980 |
| Hitting feeling | 3.75 | 3.25 | 5.00 | 4.50 | 4.25 | 5.00 | 3.00 | 2.25 |

Resilience coefficient: (Vb/Vh)

TABLE 2

| | Ex. 7 | Ex. 8 | Ex. 9 | Ref. 3 | Ref. 4 | Ref. 5 |
|---|---|---|---|---|---|---|
| Insert plate for hitting face | | | | | | |
| Material | Amorphous alloy of zirconium base | Amorphous alloy of zirconium base | Amorphous alloy of zirconium base | Stainless steel | Titanium | duralumin |
| Composition (Atomic %) | | | | | | |
| Zr | 55 | 64 | 55 | | | |
| Al | 10 | 10 | 10 | | | |
| Cu | 25 | 15 | 30 | | | |
| Ni | 10 | 10 | 5 | | | |
| Hf | — | 1 | — | | | |
| Amorphous ratio (%) | 76 | 81 | 93 | | | |
| Young's modulus x ($kgf/mm^2$) | 7200 | 15000 | 6500 | 20800 | 11600 | 7000 |
| Vickers hardness z (HV) | 370 | 500 | 500 | 370 | 360 | 140 |
| Thickness (mm) | 3.0 | 3.0 | 3.0 | 3.0 | 3.0 | 3.0 |
| Injury on the hitting face | little | very little | very little | little | little | many |
| Soft feeling performance | very good | good | very good | bad | good | very good |

TABLE 3

| | Ex. 10 | Ex. 11 | Ex. 12 | Ref. 6 | Ref. 7 | Ref. 8 |
|---|---|---|---|---|---|---|
| Face plate | | | | | | |
| Material | Amorphous alloy of zirconium base | Amorphous alloy of zirconium base | Amorphous alloy of zirconium base | Stainless steel | Titanium | duralumin |
| Composition (Atomic %) | | | | | | |
| Zr | 55 | 64 | 55 | | | |
| Al | 10 | 10 | 10 | | | |
| Cu | 25 | 15 | 30 | | | |
| Ni | 10 | 10 | 5 | | | |
| Hf | — | 1 | — | | | |
| Amorphous ratio (%) | 75 | 79 | 94 | | | |
| Young's modulus x ($kgf/mm^2$) | 7200 | 15000 | 6500 | 20800 | 11600 | 7000 |
| Vickers hardness z (HV) | 370 | 500 | 500 | 370 | 360 | 140 |
| Thickness (mm) | 3.4 | 2.9 | 2.4 | 3.2 | 3.0 | 4.5 |
| Injury on the hitting face | little | very little | very little | little | little | many |
| Soft feeling performance | very good | good | very good | bad | good | very good |

The invention claimed is:

1. A golf club head comprising a hitting face for golf balls, said hitting face formed at least partially by a metallic material, and said metallic material satisfying the following relation:

$$y \geqq 0.006x+60$$

wherein x is Young's modulus in units of $kgf/mm^2$, and y is tensile strength in units of $kgf/mm^2$, and wherein said metallic material has a young's modulus of 3,000 to 12,000 $kgf/mm^2$, and a tensile strength of 105 to 175 $kgf/mm^2$ and said hitting face has at least partially a hitting portion which consists of said metallic material with a thickness of 1 to 3 mm.

2. The golf club head according to claim 1, wherein said metallic material is an amorphous metal.

3. The golf club head according to claim 1, wherein said metallic material is an amorphous alloy of a zirconium base.

4. The golf club head according to claim 1, wherein said metallic material is an amorphous alloy comprising the elements Zr, Al, Cu, Ni, and Hf or an amorphous alloy comprising the elements Zr, Al, Cu, and Ni.

5. The golf club head according to claim 1, wherein said metallic material is an amorphous alloy comprising the elements Zr, Al, Cu, Ni, and Hf or an amorphous alloy comprising the elements Zr, Al, Cu, and Ni.

6. The golf club head according to claim 1, wherein said metallic material has a Young's modulus of 5,000 to 12,000 $kgf/mm^2$ and a tensile strength of 105 to 400 $kgf/mm^2$.

7. The golf club head according to claim 1, wherein said metallic material has a Young's modulus of 5,000 to 12,000 $kgf/mm^2$ and a tensile strength of 130 to 400 $kgf/mm^2$.

8. The golf club head according to claim 1, wherein the metallic metal is an amorphous metal expressed by the formula:

$M_aX_b$, wherein M represents two or more elements selected from the group consisting of Zr, V, Cr, Mn, Fe, Co, Ni, Cu, Ti, Mo, W, Ca, Li, Mg, Si, Al, Pd and Be; X is an element selected from the group consisting of Y, La, Ce, Sm, Md, Hf, Nb and Ta; and a and b represent atomic percentages in the ranges of $65 \leqq a \leqq 100$ and $0 \leqq b \leqq 35$, respectively.

9. The golf club head according to claim 1 wherein the metallic material is an amorphous metal of the formula: $Zr_cM_dX_e$, wherein Zr is Zirconium; M is an element selected from the group consisting of V, Cr, Mn, Fe, Co, Ni, Cu, Ti, Mo, W, Ca, Li, Mg, Si, Al, Pd and Be; X is an element selected from the group consisting of Y, La, Ce, Sm, Md, Hf, Nb and Ta; and c, d and e represent atomic percentages within the ranges of $20 \leqq c \leqq 80$, $20 \leqq d \leqq 80$, and $0 \leqq e \leqq 35$, respectively.

10. The golf club head according to claim 1 wherein the metallic material is an amorphous metal of the formula: $Zr_cM_dX_e$, wherein Zr is Zirconium; M is an element selected from the group consisting of V, Cr, Mn, Fe, Co, Ni, Cu, Ti, Mo, W, Ca, Li, Mg, Si, Al, Pd and Be; X is an element selected from the group consisting of Y, La, Ce, Sm, Md, Hf, Nb and Ta; and c, d and e represent atomic percentages within the ranges of $50 \leqq c \leqq 75$, $25 \leqq d \leqq 50$, and $0 \leqq e \leqq 1$, respectively.

11. The golf club head according to claim 1, wherein the back of said hitting portion is not supported by a support member.

12. The golf club head of claim 1 wherein the head is wood.

13. The golf club head of claim 1 wherein the head is iron.

14. The golf club head of claim 1 wherein the hitting portion has uniform thickness.

15. The golf club head of claim 1 wherein the head comprises a head body and a face plate made of said metallic material and the head body is provided with a face mounting part for attaching the face plate comprising a periphery of a hitting face, and the face mounting part is provided with a step down zone.

16. The golf club head of claim 1 wherein the head comprises a head body and a face plate made of said metallic material wherein the face plate is constructed with a thicker central part with a periphery part whose thickness reduces gradually outward.

17. The golf club head of claim 1 wherein the head comprises a head body and a face plate made of said metallic material wherein the face plate is constructed with a thinner central part with a periphery part whose thickness increases gradually outward.

18. A golf club head comprising a hitting face for golf balls, the surface of said hitting face being formed at least partially by a metallic material satisfying the following relationship:

$$z \geqq (x/60)+200$$

wherein x is Young's modulus in units of kgf/mm$^2$, and z is Vickers hardness in units of HV, and wherein said metallic material has a Young's modulus of 3,000 to 12,000 kgf/mm$^2$ and a Vickers hardness of 400 to 1,000 HV and said hitting face has at least partially a hitting portion which consists of said metallic material with a thickness of 1 to 3 mm.

19. The golf club head according to claim 18, wherein said metallic material is an amorphous metal.

20. The golf club head according to claim 18, wherein said metallic material is an amorphous alloy of a zirconium base.

21. The golf club head according to claim 20, wherein said metallic material satisfies the following relation:

y>0.006x+63 wherein y is tensile strength in units of kgf/mm$^2$.

22. The golf club head according to claim 18, wherein said metallic material has a Young's modulus of 5,000 to 12,000 kgf/mm$^2$ and a Vickers hardness of 400 to 1,000 HV.

23. The golf club head according to claim 18, wherein said metallic material has a Young's modulus of 5,000 to 12,000 kgf/mm$^2$ and a Vickers hardness of 400 to 1,000 HV.

24. The golf club head according to claim 18, wherein said metallic material has a tensile strength of 80 to 400 kgf/mm$^2$.

25. The golf club head according to claim 18, wherein the metallic metal is an amorphous metal expressed by the formula:

$M_aX_b$, wherein M represents two or more elements selected from the group consisting of Zr, V, Cr, Mn, Fe, Co, Ni, Cu, Ti, Mo, W, Ca, Li, Mg, Si, Al, Pd and Be; X is an element selected from the group consisting of Y, La, Ce, Sm, Md, Hf, Nb and Ta; and a and b represent atomic percentages in the ranges of $65 \leqq a \leqq 100$ and $0 \leqq b \leqq 35$, respectively.

26. The golf club head according to claim 18 wherein the metallic material is an amorphous metal of the formula: $Zr_cM_dX_e$, wherein Zr is Zirconium; M is an element selected from the group consisting of V, Cr, Mn, Fe, Co, Ni, Cu, Ti, Mo, W, Ca, Li, Mg, Si, Al, Pd and Be; X is an element selected from the group consisting of Y, La, Ce, Sm, Md, Hf, Nb and Ta; and c, d and e represent atomic percentages within the ranges of $20 \leqq c \leqq 80$, $20 \leqq d \leqq 80$, and $0 \leqq e \leqq 35$, respectively.

27. The golf club head according to claim 18 wherein the metallic material is an amorphous metal of the formula: $Zr_cM_dX_e$, wherein Zr is Zirconium; M is an element selected from the group consisting of V, Cr, Mn, Fe, Co, Ni, Cu, Ti, Mo, W, Ca, Li, Mg, Si, Al, Pd and Be; X is an element selected from the group consisting of Y, La, Ce, Sm, Md, Hf, Nb and Ta; and c, d and e represent atomic percentages within the ranges of $50 \leqq c \leqq 75$, $25 \leqq d \leqq 50$, and $0 \leqq e \leqq 1$, respectively.

28. The golf club head according to claim 18, wherein a thickness of said metallic material is 1 to 3 mm.

29. The golf club head according to claim 18, wherein said metallic material has a young's modulus of 3,000 to 10,000 kgf/mm$^2$.

30. The golf club head according to claim 18, wherein the back of said hitting portion is not supported by a support member.

31. The golf club head of claim 18 wherein the head is wood.

32. The golf club head of claim 18 wherein the head is iron.

33. The golf club head of claim 18 wherein the hitting portion has uniform thickness.

34. The golf club head of claim 18 wherein the head comprises a head body and a face plate made of said metallic material and the head body is provided with a face mounting part for attaching the face plate comprising a periphery of a hitting face, and the face mounting part is provided with a step down zone.

35. The golf club head of claim 18 wherein the head comprises a head body and a face plate made of said metallic material wherein the face plate is constructed with a thicker central part with a periphery part whose thickness reduces gradually outward.

36. The golf club head of claim 18 wherein the head comprises a head body and a face plate made of said metallic material wherein the face plate is constructed with a thinner central part with a periphery part whose thickness increases gradually outward.

37. A golf club head comprising a hitting face for golf balls, said hitting face formed at least partially by a metallic material, and said metallic material satisfying the following relationship:

$$y \geqq 0.006x+60$$

wherein x is Young's modulus in units of kgf/mm$^2{}_1$ and y is tensile strength in units kgf/mm$^2$, and wherein said metallic material has a Young's modulus of 5,000 to 16,000 kgf/mm$^2$ and a tensile strength of 105 to 175 kgf/mm$^2$.

38. The golf club head according to claim 37, wherein a thickness of said metallic material is 1 to 3 mm.

39. The golf club head according to claim 37, wherein said metallic material is an amorphous metal.

40. The golf club head according to claim 37, wherein said metallic material is an amorphous alloy of a zirconium base.

41. The golf club head according to claim 37, wherein said metallic material is an amorphous alloy comprising the elements Zr, Al, Cu, Ni, and Hf or an amorphous alloy comprising the elements Zr, Al, Cu and Ni.

42. The golf club head according to claim 37, wherein said metallic material satisfies the following relation:

$$y>0.006x+63.$$

43. The golf club head according to claim 37, wherein said hitting face has at least partially a hitting portion which consists of said metallic material with a thickness of 1 to 3 mm.

44. The golf club head according to claim 37, wherein said hitting face has at least partially a hitting portion which consists of said metallic material with a thickness of 1 to 3 mm and the back of said hitting portion is not supported by a support member.

45. The golf club head of claim 37 wherein the head is wood.

46. The golf club head of claim 37 wherein the head is iron.

47. The golf club head of claim 37 wherein the hitting portion has uniform thickness.

48. The golf club head of claim 37 wherein the head comprises a head body and a face plate made of said metallic material and the head body is provided with a face mounting part for attaching the face plate comprising a periphery of a hitting face, and the face mounting part is provided with a step down zone.

49. The golf club head of claim 37 wherein the head comprises a head body and a face plate made of said metallic material wherein the face plate is constructed with a thinner central part with a periphery part whose thickness increases gradually outward.

* * * * *